United States Patent [19]

Bass

[11] 4,079,893

[45] Mar. 21, 1978

[54] AIRBRUSH

[76] Inventor: Donald E. Bass, 6743 Variel Ave., Canoga Park, Calif. 91306

[21] Appl. No.: 710,202

[22] Filed: Jul. 30, 1976

[51] Int. Cl.[2] ..... B05B 7/30

[52] U.S. Cl. ..... 239/346; 239/375; 239/409; 239/413

[58] Field of Search ..... 239/341, 346, 375, 409, 239/413, 433, 526, 530, 586, 308

[56] References Cited

U.S. PATENT DOCUMENTS

| | | | |
|---|---|---|---|
| 879,891 | 2/1908 | Paasche | 239/375 X |
| 1,104,217 | 7/1914 | Paasche | 239/375 X |
| 1,180,818 | 4/1916 | Bradley | 239/341 |
| 1,294,190 | 2/1919 | Stürcke | 239/375 X |
| 2,368,536 | 1/1945 | Gersmehl | 239/341 |
| 2,721,763 | 10/1955 | Miner | 239/308 |
| 3,880,355 | 4/1975 | Larson et al. | 239/526 X |

*Primary Examiner*—Bruce H. Stoner, Jr.
*Assistant Examiner*—Andres Kashnikow
*Attorney, Agent, or Firm*—Poms, Smith, Lande & Glenny

[57] ABSTRACT

An airbrush includes a body at the forward end of the airbrush and a plume at the rear end, the plume being for balancing the airbrush and supporting it in the user's hand. A source of fluid is included in the airbrush to be dispersed therefrom, and a needle valve through which fluid from the source flows is mounted on the body portion and the source of fluid is also connected to the needle valve. Air in an air passage passes over the needle valve to create a partial vacuum thereover to draw fluid from the source of fluid out of the needle valve and into the stream of air and out of the airbrush. An air valve on the body portion controls the flow of air through the air passage. An air supply provides air to the air passage from a source of air, and the air supply is mounted to the air passage on the plume so that the air valve is spaced from the air supply mounting to minimize the distance from the air valve to the needle valve to decrease the pressure drop between them. The plume and the body are integrally formed and an air passage extends through the plume and body to the needle valve.

5 Claims, 5 Drawing Figures

AIRBRUSH

BACKGROUND OF THE INVENTION

This invention generally relates to airbrushes. Airbrushes are extremely useful tools for creating various forms of art work. The general configuration of the airbrush includes a source of fluid which is connected to a needle valve. Air passes over the needle valve and the partial vacuum created draws fluid from the source out of the needle valve and into the airstream where the fluid is sprayed onto paper or other material. The needle valve adjusts the flow of liquid out of the source and into the airstream, but the flow of air can also be controlled to modify the rate of fluid dispersion.

It is conventional that the fluid source is mounted on the airbrush. This creates some space problems with mounting the remaining structure on the airbrush. Conventionally, airbrushes are made in two pieces, a body casting, usually made of metal, and a plume portion of plastic or other lighter material. Normally, the air hose is connected on the underside of the body casting behind the fluid source to a fitting that also holds an air valve for controlling the air through the air brush. The air hose connection is usually behind the fluid source to prevent interference of the hose by the needle valve of fluid source. However, mounting the air valve behind the source of fluid lengthens the distance in the air passage from the air valve to the needle valve which in turn increases the pressure drop therebetween. The increased pressure drop causes uneven liquid dispersion when the air valve is initially actuated and when it is deactuated. Also, moving the actuator rearward on the body can create an uncomfortable operating mode for the user of the airbrush. It is much easier to operate an airbrush if the actuator is moved forward on the body which places the actuator at the tip of the user's finger. Also, the hose connection on the bottom of the airbrush may prevent the user from moving his hand forward on the airbrush.

SUMMARY OF THE INVENTION

It is the object of the present invention to accomplish the following goals: to minimize the distance from the air valve to the needle valve, to minimize the pressure drop therebetween; to move the air valve actuator forward to allow for easier use of the airbrush; to eliminate the hose connection on the underside of the airbrush body so that the user's hand can move forward on the airbrush; to design an airbrush which is comfortable to hold and is easily balanced; and to provide a one-piece handle which conforms to the user's hand. Other objects of the invention will become evident in the following description, and it will be further shown how the above objects are met.

Figure 2:
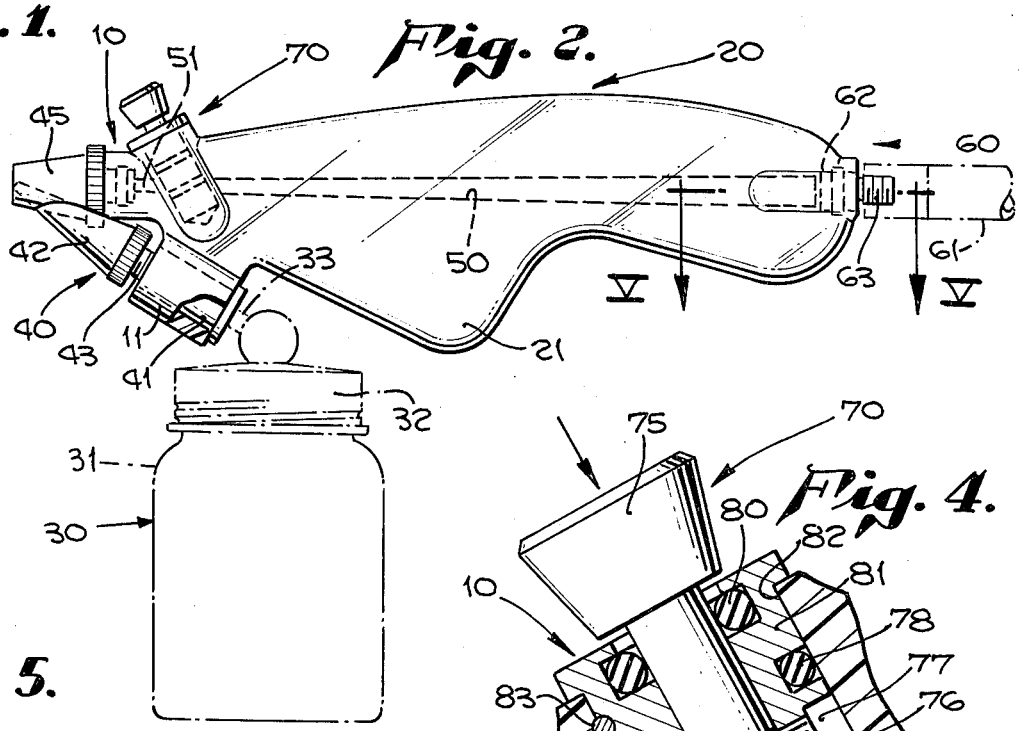
FIG. 2 is a side elevation of the airbrush of the present invention partially sectioned.

DETAILED DESCRIPTION OF THE PREFERRED EMBODIMENT:

The airbrush of the present invention comprises a body portion at the forward end of the airbrush. The body portion 10 in the exemplary embodiment is shown in detail in FIG. 3. A plume portion at the rear end of the airbrush balances the airbrush and supports it on the user's hand. In the exemplary embodiment, the plume portion 20 is at the right or rear end (FIG. 2) of the airbrush. In prior art airbrushes, the plume portion was usually a piece of material which was fastened to the body portion. In the present invention, however, the plume portion 20 and the body portion 10 are integrally formed into a combined handle means.

A source of fluid to be dispersed from the airbrush is mounted on the airbrush. In the exemplary embodiment, the source of fluid 30 comprises a container 31 having a removable lid 32. A siphon through the top includes a tube (not shown) which extends to the bottom of container 31 so that the paint can flow through the tube and into the stem member 33 of the siphon.

Fluid from the source 30 flows through a needle valve 40. Means are provided for mounting the needle valve on the body portion 10 and the source of fluid is connected to the needle valve to support the source of fluid. Turning again to the preferred embodiment, especially FIGS. 2 and 3, the needle valve 40 is shown suitably mounted on the body portion 10 in bore 12 in extension 11.

Figure 1:
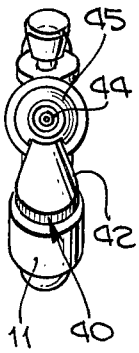
FIG. 1 is an end view of the airbrush looking from the front thereof.

The needle valve 40 is of conventional design. However, to explain briefly, the needle valve 40 includes a base 41 and a conical cover 42 which can be moved relative to the base on threads 43 for example, a hollow needle (not shown) is fixed to base 41 and extends inside conical portion 42. The needle is hollow and is in fluid communication with the stem 33 of the source of fluid 30. The needle also has a second opening along the side near the other end. When the conical portion 42 is screwed into the base portion (to the right in FIGS. 2 and 3) the inside of conical portion 42 covers the upper opening in the needle so that no fluid can pass from the stem through the needle valve. As the conical section is rotated so that it moves to the left in FIGS. 2 and 3, less of the inside of conical portion 42 is in contact with the opening of the needle, and fluid can flow through the needle into the conical member 42. As best seen in FIG. 1, conical member 42 is open at the top at 44 to allow the fluid to flow from the opening.

Air passage means passes air over the needle valve for creating a partial vacuum thereover to draw fluid from the source of fluid out of the needle valve and into the stream of air and out of the airbrush. In the exemplary embodiment, the air passage means, generally shown at 50, includes a conduit 51 in the body portion 10 of the airbrush. Air from a source of air 60 passes through the air passage 50, through conduit 51 and into the air cap 45 which is attached to body portion 10 by threading it into a bore 14 or securing it in any other suitable manner. The air cap 45 has a central opening 46 and a bottom opening 47 through which the conical member 42 extends into the central opening 46. When air is forced through conduit 51 and out of the airbrush through air cap 45, the stream of air passing over opening 44 on the conical portion 42 of needle valve 40 creates a partial vacuum in the needle valve which draws fluid from container 31 through the siphon and stem 33 into the needle and out of opening 44. The fluid is then drawn into the air stream where it is directed to a desired location. The dispersion of the liquid onto paper or other material is controlled by adjusting the needle valve to control the flow of fluid of the source, by changing the flow of air over the needle valve, and by controlling the distance of the airbrush to the paper.

Figure 4:
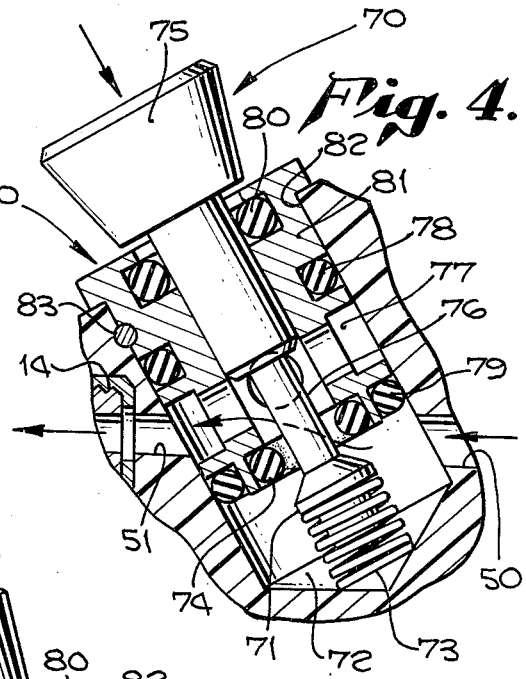
FIG. 4 is a sectional view of the air valve of the present invention showing the valve open.
Figure 5:
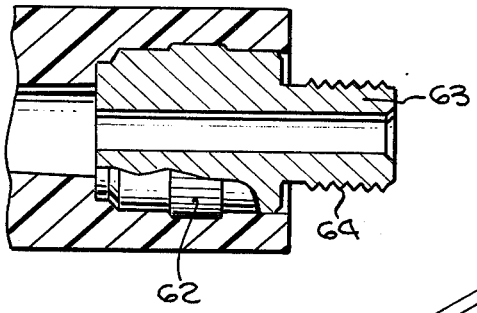
FIG. 5 is a sectional view of the filling for the air hose at the end of the airbrush taken through plane V—V in FIG. 2.

Air valve means on the body portion controls the flow of air through the air passage, and air supply means supplies air to the air passage means from a source of air. Air from the source of air 60 passes through the air hose 61 and into air conduit 50. The air valve shown generally at 70 (FIGS. 3 and 4) has a portion in the air passage 50 which can block or unblock the air passage.

Air valve means 70 includes a valve poppet 71 which is mounted for movement in inlet chamber 72. Spring 73 biases poppet 71 against the seat that includes a resilient seal 74. When valve actuator 75 is depressed, valve stem 76 urges poppet 71 off seat 74 against the bias of the spring to allow air to flow from inlet chamber 72 to outlet chamber 77 into air conduit 51. Seals 78, 79 prevent air from leaking around the air valve, and seal 80 prevents air from leaking past valve stem 75. Valve housing 81 is held in valve bore 82 by means of pin 83.

Means are provided for mounting the air supply means to the air passage means on the plume portion so that the air valve means is spaced from the means mounting the air supply means. In the exemplary embodiment, the means mounting the air supply means 60 includes a cap 62 which is integral with tube 63. The cap is attached to the end of plume portion 20 to connect the tube 63 to the air passage 50. Tube 63 is secured in the air hose 61 by the resiliency of the hose in a manner well known. The connection between the air supply means 60 and the plume portion 20 could be modified to use any pneumatic connector. Tube 63 may have threads 64 to help secure hose 61.

The plume portion and the body portion are integrally formed. As shown in FIG. 1, plume portion 20 and body portion 10 are formed of one piece of material, preferably molded plastic with openings for receiving the various components of the airbrush. The air passage 50 extends from the means mounting the air supply means near cap 62 through the plume portion and body portion to the needle valve 40.

Figure 3:
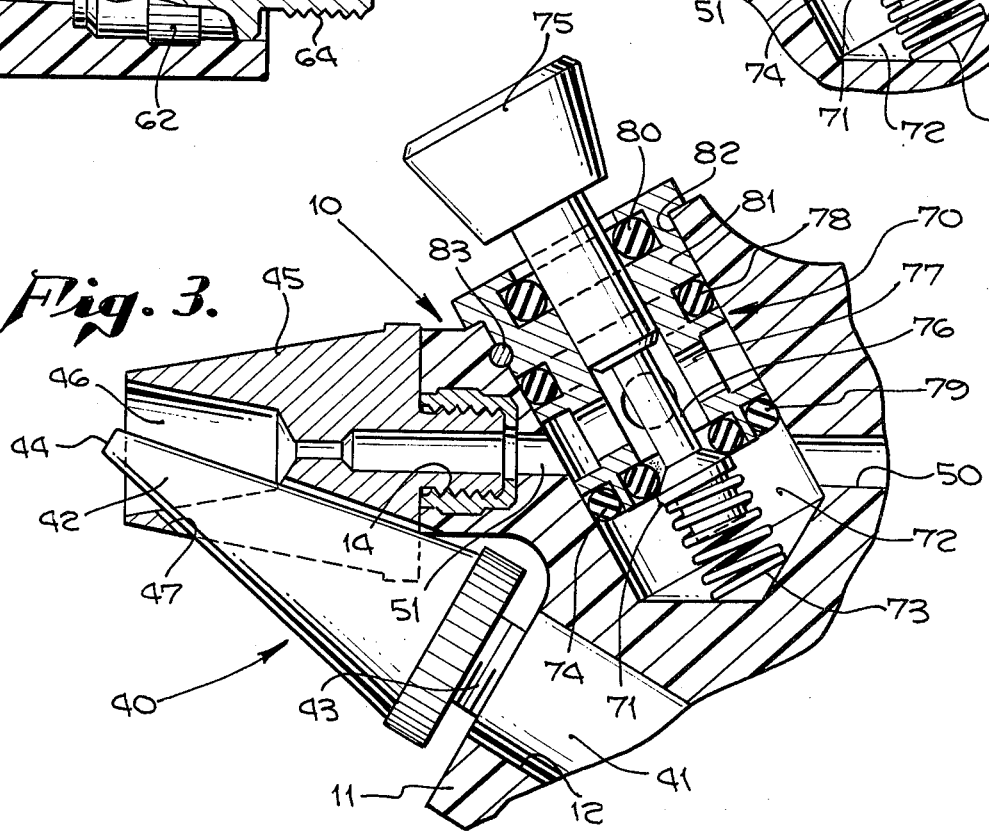
FIG. 3 is a detailed sectional view of the front end of the brush showing the air valve, the needle valve and the dispersing end of the airbrush.

The air valve 70 is mounted directly over the means mounting the needle valve 11 so that the distance from the air valve to the needle valve is minimized. As shown in FIG. 3, bore 82 for air valve means 70 almost intersects the bore 12 which receives the needle valve. It is this configuration that allows for the improved construction of minimizing the pressure drop between the air valve 70 and the tip 44 of the needle valve 40. In conventional airbrushes, the air supply would be connected to the bottom of the slot 71 and the hose would extend from the bottom of the handle. By moving the air hose through the plume, and away from the bottom of the slot 71, no provision has to be made for spacing the bottom of the slot 71 away from any structure that may be beneath the air valve such as the needle valve 40. Therefore, rather than having the air hose and the air valve aligned as in the prior art, the slot of the air valve intersects the air passage at an angle. The angle chosen allows the shortest distance between air valve means 70 and needle valve means 40 in view of the necessary placement of base 41 of the needle valve. The angle could range from perpendicular to approximately 30°, but if too small an angle is used, the valve actuator 75 will be difficult and unnatural to use.

Prior art airbrushes were rested between the user's thumb and fingers at the air hose connection on the bottom of the airbrush. To accommodate those user's who are used to holding an airbrush in that manner, the handle has been modified in the present invention to provide a downwardly extending protuberance 21 (FIG. 1) for conforming to the user's hand. As distinguished from prior art airbrushes wherein the connection of the air hose to the body is fixed by mechanical configurations, in the present device different shaped handles can be made for different sized hands.

It will be understood that various modifications and changes may be made in the configuration described above which may come within the spirit of this invention, and all such changes and modifications coming within the scope of the appended claims are embraced thereby.

I claim:

1. An airbrush comprising:

a body portion at the forward end of the airbrush and a plume portion at the rear end of the airbrush for balancing the airbrush and supporting it on the user's hand, the plume portion and the body portion being integrally formed, a source of fluid to be dispersed from the airbrush, a needle valve through which fluid from the source flows, means mounting the needle valve on the body portion and means connecting the source to the needle valve to support the source of fluid, air passage means for passing air over the needle valve for creating a partial vacuum thereover to draw fluid from the source of fluid out of the needle valve and into the stream of air and out of the airbrush, air valve means on the body portion for controlling the flow of air through the air passage means, air supply means for supplying air to the air passage means from a source of air, and means mounting said air supply means to said air passage means on said plume portion so that the air valve means is spaced from the means mounting said air supply means to minimize the distance from the air valve means to the needle valve whereby the air pressure drop therebetween is minimized, wherein the air passage means extends from the means mounting the air supply means through the plume portion and body portion to the needle valve, and wherein the air valve means is mounted directly over the means mounting the needle valve so that the distance from the air valve means to the needle valve is minimized.

2. The airbrush of claim 1 wherein the air passage means extends in a generally straight line from the means mounting the air supply means to the needle valve.

3. The airbrush of claim 2 wherein the air valve means comprises a slot mounted in a bore in the airbrush, and the bore intersects the air passage means at an angle thereto.

4. The air brush of claim 3 wherein the air valve means further comprises actuator means on the forward part of the body portion for opening and closing the air valve means, and wherein the angle is inclined so that the actuator means is the closest part of the air valve means to the forward end of the airbrush.

5. The airbrush of claim 1 wherein the body portion and plume portion are a one piece handle structure, said handle structure having a downwardly extending protuberance for conforming to the user's hand.

* * * * *